United States Patent [19]

Marsalona

[11] Patent Number: 4,689,897

[45] Date of Patent: Sep. 1, 1987

[54] COMPOSITE GLOVE DRYING DEVICE

[76] Inventor: Guy Marsalona, 11653 Hackberry St., Palm Beach Gardens, Fla. 33410

[21] Appl. No.: 923,900

[22] Filed: Oct. 28, 1986

[51] Int. Cl.[4] ..... F26B 9/10

[52] U.S. Cl. ..... 34/103; 34/104; 34/239; 273/32 R; 223/78

[58] Field of Search ..... 34/103, 104, 239; 273/32 R, 32 B; 223/78

[56] References Cited

U.S. PATENT DOCUMENTS

| | | | |
|---|---|---|---|
| 754,539 | 3/1904 | Burr | 34/103 |
| 2,524,285 | 10/1950 | Chezum | 223/78 |
| 3,138,699 | 6/1964 | Taylor | 34/239 |
| 3,166,439 | 1/1965 | Dennhofer | 34/104 |
| 3,409,142 | 11/1968 | Mechaneck | 223/78 |
| 3,477,622 | 11/1969 | Appelt | 223/78 |
| 3,486,670 | 12/1969 | Sutton | 223/78 |
| 3,917,266 | 11/1975 | Kiey | 223/78 |
| 4,084,733 | 4/1978 | Perlmutter | 223/78 |
| 4,193,209 | 3/1980 | Lovison | 34/239 |
| 4,209,913 | 7/1980 | Wallin et al. | 34/103 |
| 4,565,287 | 1/1986 | Rede et al. | 223/78 |
| 4,596,078 | 6/1986 | McCartney | 34/104 |
| 4,613,066 | 9/1986 | Saucy | 34/103 |

FOREIGN PATENT DOCUMENTS 2557011 12/1983 France .

*Primary Examiner*—Albert J. Makay
*Assistant Examiner*—David W. Westphal
*Attorney, Agent, or Firm*—Alvin S. Blum

[57] ABSTRACT

A drying device for a golf glove and the like formed in the shape of a hand with extended thumb and fingers for holding and maintaining the shape of a wet glove during drying. The device is a thin-walled container, as, for example, a blow-molded plastic bottle with a resealable opening for containing golf tees, powder or other useful items. The device includes means for detachably attaching the container to a golf bag, golf club, ski pole and the like for convenient deployment during drying.

20 Claims, 4 Drawing Figures

COMPOSITE GLOVE DRYING DEVICE

BACKGROUND OF THE INVENTION

This invention relates to devices for supporting wet gloves in extended form during drying and more particularly to thin-walled containers with a generally hand shape that can serve as glove drying forms as well as containers for useful items.

Glove forms for molding and drying gloves are well known in the prior art and include U.S. Pat. Nos. 3,166,439; 3,409,142; 3,477,622; 3,486,670; 4,018,382, 4,084,733; 4,565,287 and French Pat. No. 2,557,011. The instant invention as disclosed and claimed herein provides distinct and useful advantages not previously known to the prior art.

Gloves used for sports such as golf, archery, handball, skiing, and the like are often made of fine soft leather. The hands perspire during the sporting activity, wetting the glove with perspiration. At the conclusion of the activity, the wet glove may be forced into a bag with other items where it remains untouched until the next occasion which may be the next day or a year away. It is unpleasant to put on a wet glove or a glove that has dried and/or mildewed in a compressed condition. Furthermore, the lifetime and performance of a glove so treated is seriously degraded.

Therefore, it is an object of this invention to provide a form upon which to dry a glove that is inexpensive to produce and that offers such convenience of use that it will encourage proper care of the glove.

SUMMARY OF THE INVENTION

It is an object of the present invention to provide a glove drying device designed to enable the thorough drying of a wet glove placed thereon such that the original form, shape and configuration of the glove are retained.

A further object is to provide a glove drying device that is light in weight, simple and inexpensive to manufacture and easily stored after use.

Yet another object of the invention is to provide a glove drying device with attaching means for conveniently and reversibly attaching said device to a support means for deploying the device, with wet glove thereon, in an exposed manner for air drying, wherein said support means may include an implement of the sport such as a golf bag, golf club, ski pole, bowling ball bag, archery bow and the like.

Yet another object of the invention is to provide a glove drying device that is also a resealable container or bottle that can be used to hold a liquid or solids that may be useful in conjunction with the sporting activity. The device may be used to carry golf tees, hand lotion, powder, rubbing alcohol, sunscreen, insect repellent, wax, and the like.

These objects and advantages are generally attained by providing a hollow thin-walled, molded container with a substantially hand shape, having four fingers and optionally a thumb, with a resealable opening in the region opposite the fingers. The device may be slip cast or made by joining two vacuum thermo formed portions, but is preferably blow molded from a thermoplastic that is liquid impermeable, so that the container may hold liquid. The hand design may include projecting or recessed surface grooves, bars or bosses to permit air circulation between glove and device to enhance drying. The resealable opening may have a scre thread to receive a screw cap closure or may be molded to receive a resilient plastic friction closure. Attaching means may include snaps, hook and loop fasteners, spring clips and other attaching means well known in the prior art. The attaching means may be especially configured to attach to a particular sporting device such as a ski pole or golf club and may take advantage of the resilient nature and convenient moldability of the blow molded product.

DETAILED DESCRIPTION OF THE PREFERRED EMBODIMENT

Figure 1:
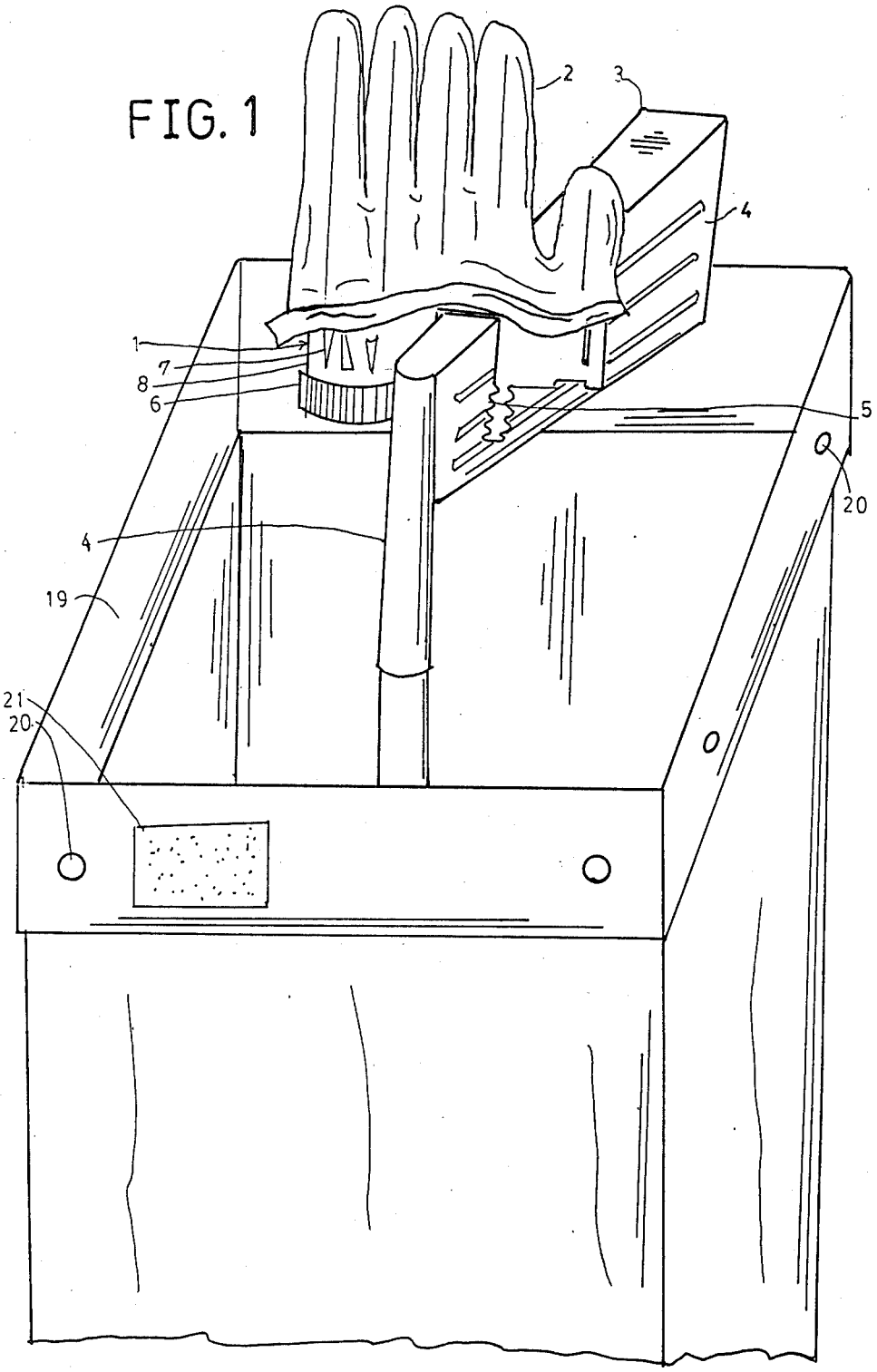
FIG. 1 is a perspective view of the device in use drying a golf glove deployed on a golf club in a golf bag.
Figure 2:
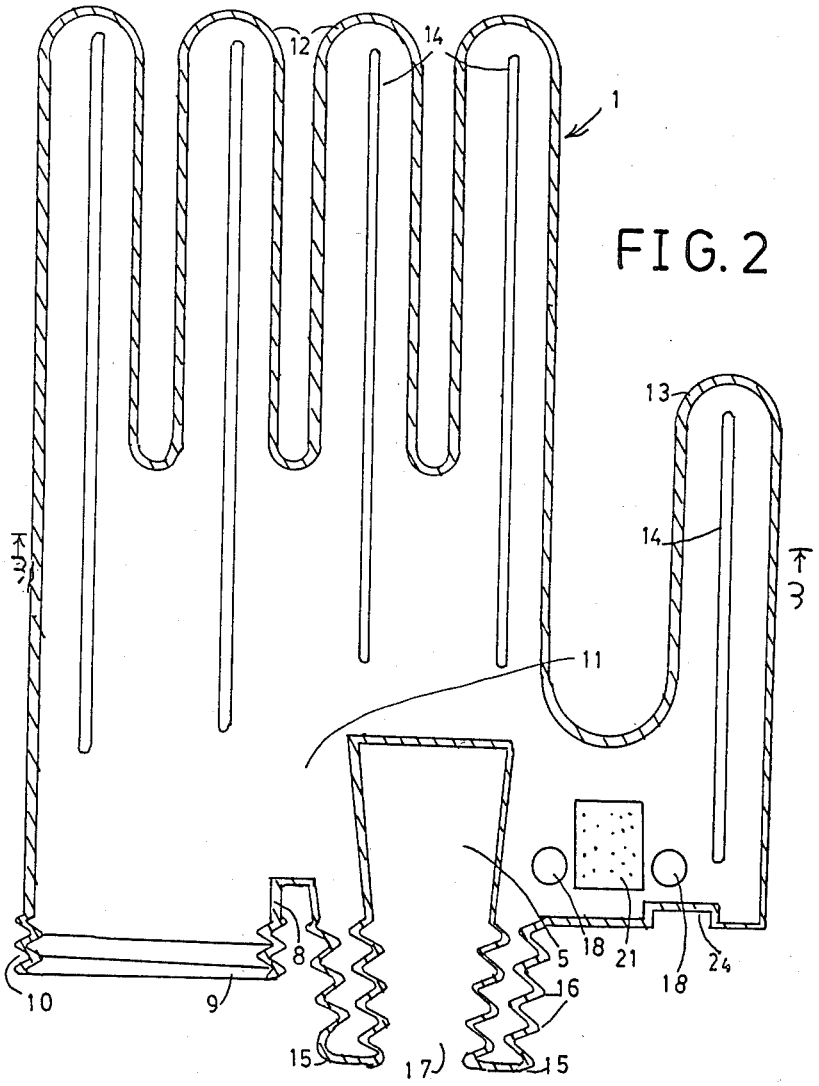
FIG. 2 is a cross sectional front elevational view of the device of FIG. 1.
Figure 3:
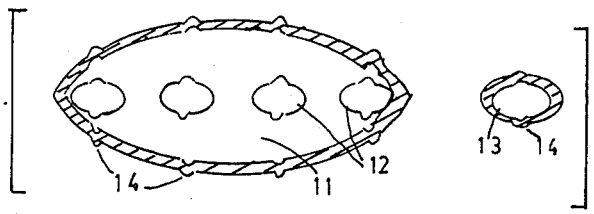
FIG. 3 is a cross section view taken on plane 3—3 of FIG. 2.
Figure 4:
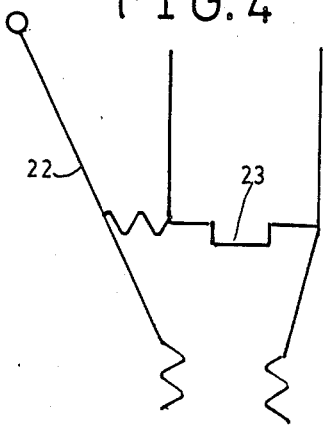
FIG. 4 is a side view of a clip representative of attaching means that may be fixed to the device.

FIG. 1 shows the preferred embodiment of the invention 1 in use drying a golf glove 2 stretched thereon to retain its shape while drying. The device is supported in upright position for good air circulation and to prevent the glove 2 from falling off, by engaging the head 3 of golf club 4 in springy slot 5, in golf bag 19. Screw cap 6 prevents the golf tees 7 from falling out of the device. FIGS. 2 and 3 show more detail of the unique structure of the invention. It is a thin-walled, hollow container having a neck 8 with opening 9 and screw threads 10 for sealing with screw cap 6 to hold materials that may be useful before, during or after the sport activity for which the glove is intended. The device has the general shape of a hand with palm 11, fingers 12 and thumb 13. Longitudinal surface projections 14 raise the wet glove somewhat above the surface to provide better air circulation to enhance drying. They perform a secondary function of stiffening the structure to get greater rigidity with a thin wall for cost and weight reduction. The slot 5 is formed with projections 15 having transverse corrugations 16 to provide a springy clamp-like action at the slot entrance 17 to facilitate insertion of the golf club head 3 and to provide a gripping action to keep the device firmly in place. Alternative attaching slot configurations may be employed when the device is to be attached to other implements such as, for example, the handle of a bowling ball bag, a ski pole, an archery bow, or a rifle. Alternatively, the device may have other attaching means well known in the art, including the snaps 18 for snapping onto the snaps 20 on golf bag 19, or velcro (TM) connectors 21. Alternatively, the plastic clamp 22 of FIG. 4 which may be an inexpensive profile extrusion, is cemented at projections 23 to recess 24. A preferred method of manufacture of the device is by blow molding and a preferred material of manufacture is a thermoplastic such as polyolefin or polycarbonate which are impermeable to moisture. Blow molded thermoplastic glove drying forms can be made with a very thin wall with intricate detail with relatively inexpensive molds, and without any costly postmolding processes. The hollow digits and palms have much greater regidity than an equivalent amount of material in a molded sheet form. The molded sheet form has better air circulation by virtue of having an open side, but the surface of the instant invention is modified by projections and depressions to enhance air circulation. The device may be made of a clear plastic to permit identification of its contents, or it may be made of a flesh-colored plastic.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A composite device for drying a wet glove and for containing liquid, solid and powdered materials, comprising:

a. an impermeable container having a shape generally conforming to the shape of a hand for holding a wet glove open to a drying atmosphere to enhance drying and to maintain the glove shape, said container having an opening to receive and dispense said materials;

b. resealable closure means formed at said opening to close said opening to retain said materials in said container; and c. device attaching means connected to said container for removeably attaching said container to a support during the drying process.

2. The invention of claim 1 formed of thin-walled thermoplastic.

3. The invention of claim 2 is a blow-molded part.

4. The invention of claim 1, wherein the surface of said container in regions generally contacting said glove has projections to enhance air circulation between said glove and said device and to improve the rigidity of said device.

5. The invention of claim 1, wherein the surface of said container in regions generally contacting said glove has depressions to enhance air circulation and improve rigidity.

6. In the invention of claim 1, said closure means including screw thread means to receive a screw cap.

7. In the invention of claim 1, said closure means including friction cap receiving means to receive a resilient friction sealing cap.

8. In the invention of claim 1, said attaching means including snaps.

9. In the invention of claim 1, said attaching means including spring clamp means.

10. In the invention of claims 1, said attaching means including hook and loop fastener means.

11. In the invention of claim 1, said attaching means including springy slot means.

12. A composite device for containing solid, liquid and powdered materials therein and for drying a wet glove, comprising:

a. a blow molded, thermoplastic, thin walled container having a shape generally conforming to the shape of a hand for holding a wet glove open to a drying atmosphere to enhance drying and to maintain the glove shape, said container having an opening to receive and dispense said materials;

b. resealable closure means molded into said opening including screw threads to receive a screw cap for sealing said materials in said container; and c. device attaching means connected to said container for removably attaching said container to a support during the drying process.

13. In the invention of claim 12, said attaching means comprises a springy slot means molded into said container.

14. In the invention of claim 13, said slot means is configured to receive a golf club.

15. In the invention of claim 13, said slot means is configured to receive a ski pole.

16. In the invention of claim 13, said slot means is configured to receive an archery bow.

17. In the invention of claim 13, said slot means is configured to receive a handle of a bag.

18. In the invention of claim 13, said slot means is configured to receive a rifle.

19. In the invention of claim 12, said attaching means including spring clamp means.

20. A composite device for drying a wet glove and for also containing liquid, solid and powdered materials, comprising: an impermeable container having a shape generally conforming to the shape of a hand for holding a wet glove open to a drying atmosphere to enhance drying and to maintain the glove shape, said container having an opening to receive and dispense said materials, said opening including resealable closure means for sealing said materials within said container.

* * * * *